US005728051A

United States Patent [19]

Chi

[11] Patent Number: 5,728,051

[45] Date of Patent: Mar. 17, 1998

[54] MASSAGER HAVING REMOVABLE MASSAGE ELEMENTS

[76] Inventor: Stephen Chi, No. 7, Lane 145, Te Hsing Road, Ta Chia, Taichung, Taiwan

[21] Appl. No.: 606,760

[22] Filed: Feb. 27, 1996

[51] Int. Cl.[6] ..... A61H 15/00

[52] U.S. Cl. ..... 601/112; 601/28; 601/32

[58] Field of Search ..... 601/27, 28, 32, 601/112, 84, 85, 86, 87

[56] References Cited

FOREIGN PATENT DOCUMENTS

| | | | |
|---|---|---|---|
| 593941A1 | 8/1994 | European Pat. Off. | 601/112 |
| 2274395A | 7/1994 | United Kingdom | 601/112 |

*Primary Examiner*—Robert A. Hafer
*Assistant Examiner*—Benjamin K. Koo
*Attorney, Agent, or Firm*—Bacon & Thomas

[57] ABSTRACT

A massager with rotary and resilient action includes a base, a movable cover, drive motor means, two worm gears and a massaging means. The worm gears and the massaging means consisting of multiple rows of massaging units are disposed intermediate the base and the movable cover. By means of the drive motor means which drive a belt pulley to rotate the worm gears, multiple screw pinions at the lower portion of the massaging units are driven. The screw pinions are insertably connected to multiple connecting heads so that the connecting heads may be rotated therewith. Each screw pinion has an upper side provided with four insert slots for receiving a plurality of pins on the lower side of each connecting head so that the position of a massaging head fitted on the connecting head may be adjusted to achieve inwardly and outwardly massaging actions.

4 Claims, 4 Drawing Sheets

MASSAGER HAVING REMOVABLE MASSAGE ELEMENTS

BACKGROUND OF THE INVENTION (a) Field of the Invention

The present invention relates generally to a massager, and more particularly to a massager which provides circular massaging actions to enhance the comfort in massaging. Besides, the massaging direction thereof may be adjusted as desired.

(b) Description of the Prior Art

Existing massagers generally fall include the fixed type of massaging pads and power-driven massagers. There are, however, the following drawbacks with the prior art.

1. With conventional massaging pads consisting of a multiplicity of oval smooth pebbles protrudently provided on a pad for massaging the soles, the users may feel comfortable or even painful when stepping on the pebbles. Besides, the pebbles cannot apply a suitable force to massage the soles.

2. With conventional power-driven massagers using rotary rollers with massaging heads, the massaging heads are generally made of hard material which may hurt the skin of the user upon contact.

3. For improved power-driven massagers capable of change of massaging action and provided with rotary massaging means, although the massaging effects have been improved, the massaging heads are also made of hard material.

SUMMARY OF THE INVENTION

Accordingly, a primary object of the present invention is to provide a massager capable of rotary action to provide better comfort and enhanced massaging action.

In order to achieve the above-mentioned object, the massager according to the present invention essentially comprises two power-driven worm gear sets and massaging means such that a plurality of connecting heads of the massaging means may cyclically rotate to cause a soft massaging head on each connecting head to rotate in a circular motion to achieve massaging effects while providing comfort to the user. The massaging means of the massager according to the present invention are further comprised of a plurality of screw pinions insertably connected to the connecting heads by means of four equi-angularly spaced insert slots located in an upper surface of each of the screw pinions for receiving a couple of pins on a lower side of each of the connecting heads. The massaging positions of the massager may be adjusted by changing the position of the pins in the insert slots.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
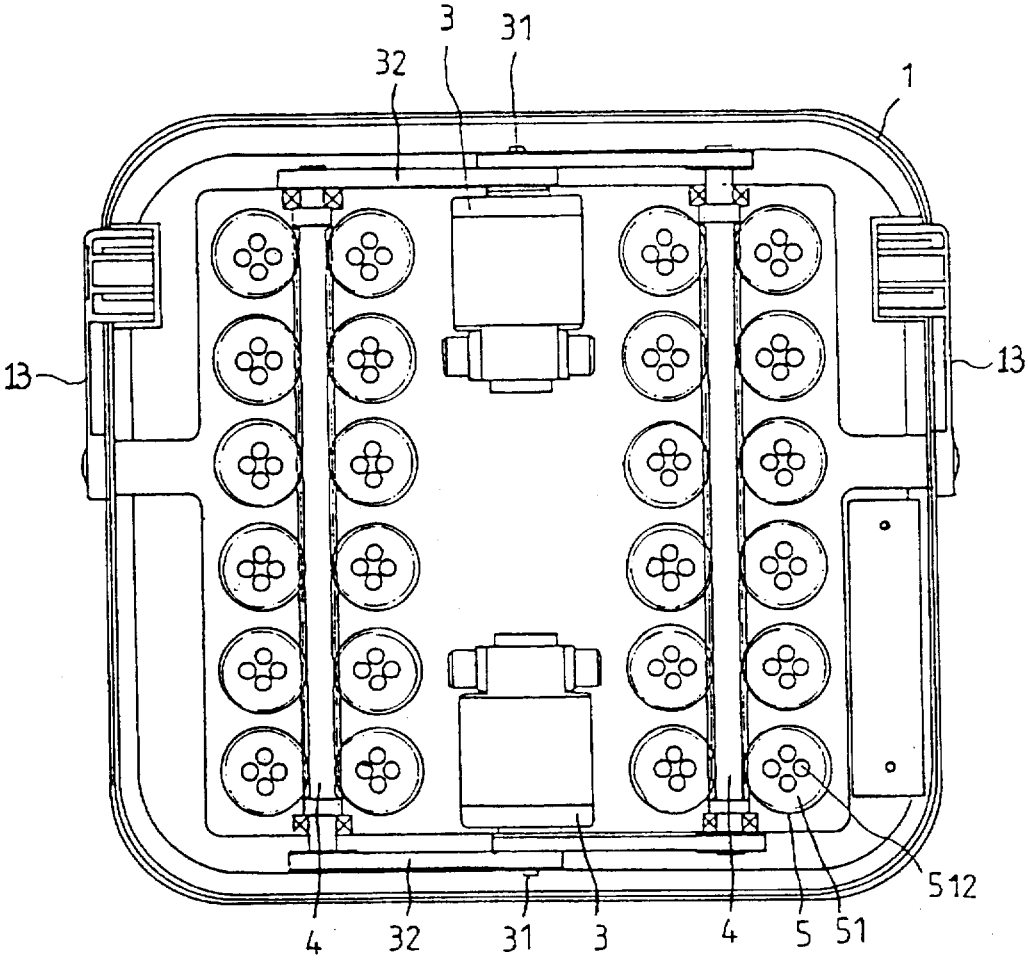
FIG. 1 is a schematic view of the massager according to present invention in a partly assembled state.
Figure 2:
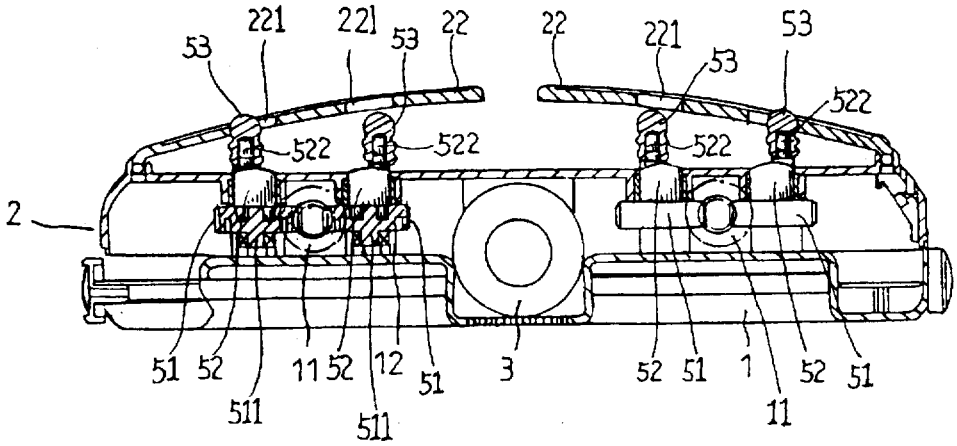
FIG. 2 is a schematic side view of the massager of the invention.
Figure 3:
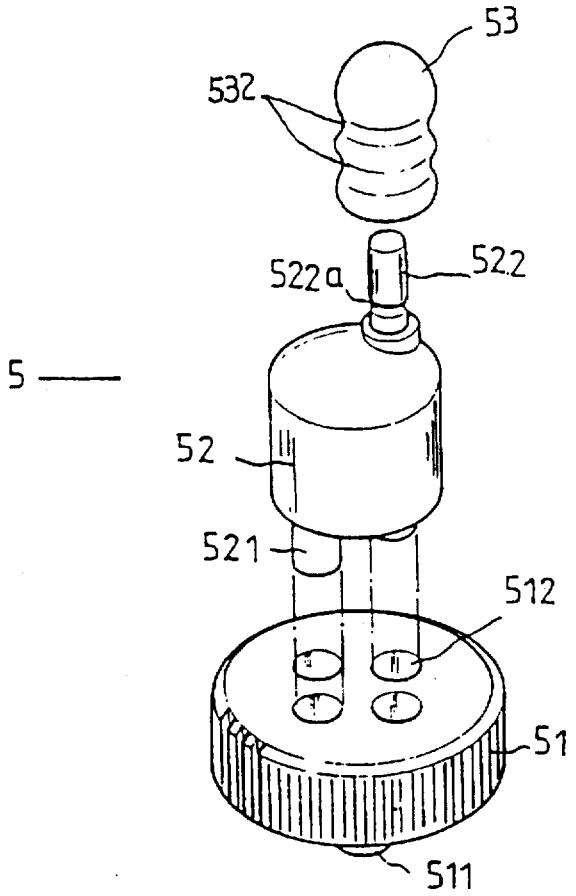
FIG. 3 is an exploded elevational view of a massaging means of the massager of the invention.
Figure 4:
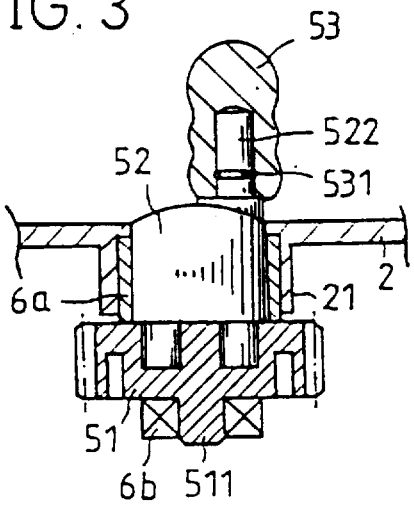
FIG. 4 is a sectional view of the massaging means of the massager of the invention.

With reference to FIGS. 1, 2, 3 and 4, a preferred embodiment of the massager according to the present invention essentially comprises a base 1, a movable cover 2, and a couple of drive motor means 3 disposed therebetween. The drive motor means 3 drives a belt pulley 32 via a shaft 31 to rotate a worm gear set 4 which is located on a post support 11, with multiple rows of studs 12 respectively positioning a post shaft 511 of a screw pinion 51 at a lower portion of a massaging means 5. The post shaft 511 has insertably provided thereon a small bearing 6*a* for facilitating smooth rotation. The movable cover 2 is placed on top the massaging means 5 so that a post socket 21 at a lower rim thereof fits onto a connecting head 52 of the massaging means 5 and such that the connecting head 52 projects from the post socket 21. The connecting head 52 is further provided with a shaft sleeve 6*a* at a middle portion thereof, as shown in FIG. 4.

The massaging means 5 of the present invention is essentially comprised of the screw pinions 51, the connecting heads 52 and multiple massaging heads 53. Each of the screw pinions 51 is insertably connected to each of the connecting heads 52 having its post shaft 511 located at the lower rim thereof. An upper side of the screw pinion 51 is provided with four equi-angularly spaced insert slots 512 for matching a couple of pins 521 at a lower side of the connecting head 52. By changing the position of the pins 521 on the screw pinion 52 by inserting them into different pairs of insert slots 512, the rotational position of the connecting head 52 relative to the screw pinion 51 may be adjusted between 90 degrees and 180 degrees. A rod 522 is further provided on an upper side of the connecting head 52 near its circumferential rim. The rod 522 has an annular mounting groove 522*a* at a lower rim thereof for receiving a retaining element 531 disposed within a soft massaging head 53, as shown in FIG. 3. The massaging head 53 is configured to have a plurality of inner ridges 532 so as to afford suitable resilience to the massaging head 53, thereby providing better comfort in massaging.

The principles of operation of the massager according to the present invention are described below.

The driving mechanism employed in the present invention is stable and reliable. With reference to FIG. 4, the shaft 31 of each drive motor means 3 drives the belt pulley 32 to rotate the worm gear set 4 the teeth of which in turn rotate the screw pinions 51 engaging therewith, driving the massaging means 5 to rotate.

Furthermore, two curved movable press plates 22 having multiple circular through holes 221 thereon are pivotally connected to the movable cover 2 at both sides thereof. When the press plates 22 receive an external impact, the massaging heads 53 of the massaging means 5 will project from the corresponding circular through holes 221. The shape of the press plates 22 is designed ergonomically to provide better touch. Besides, such an arrangement prevents the massaging heads 53 from direct contact with the outside (see FIGS. 5 and 6).

Figure 7A:
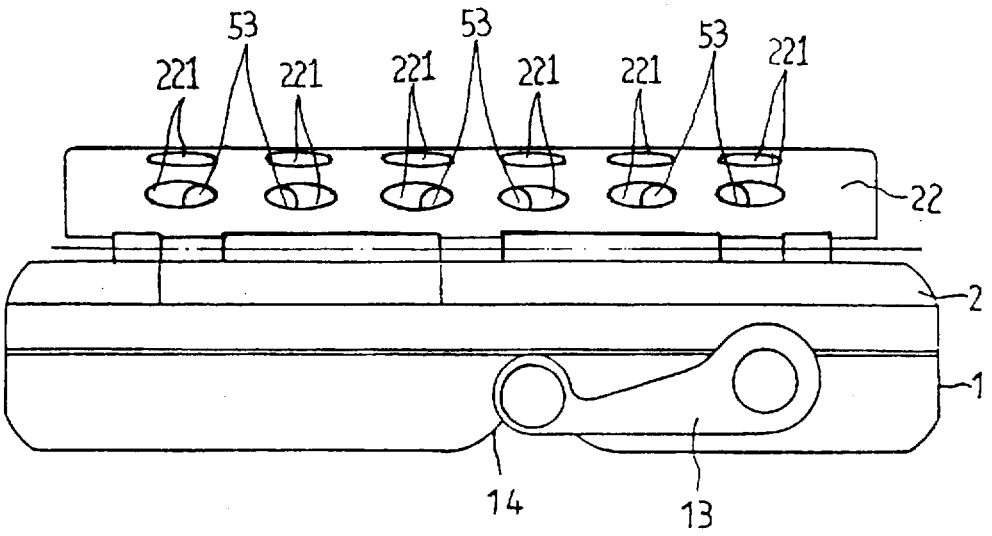
FIGS. 7*a* and 7*b* are schematic side views of the massager of the invention, showing an adjustable leg support.
Figure 7B:
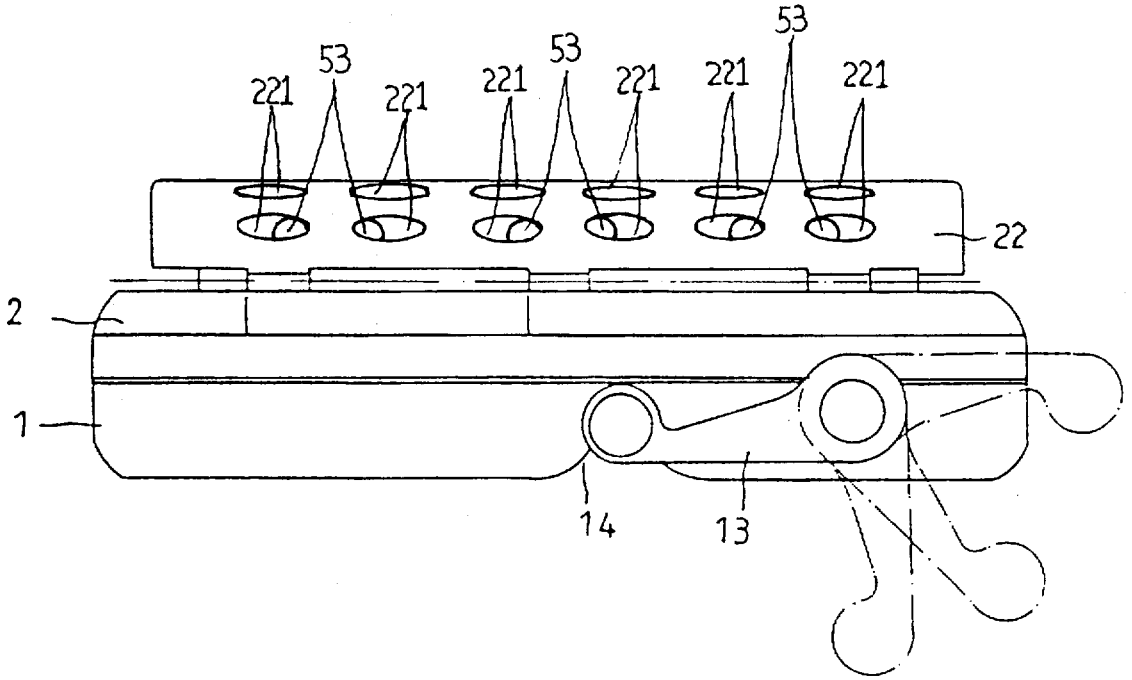

In addition, with reference to FIGS. 7*a* and 7*b*, an adjustable leg support 13 is provided at a lower rim of the base 1 for angle adjustment of the massager of the invention. As such a structure is well known in the art, it is not discussed in detail herein. A recess 14 may be formed in a middle portion of the base 1 for accommodating the leg support 13 to faciliate storage. The leg support 13 may also serve as a handle to facilitate hand carrying.

Figure 5:
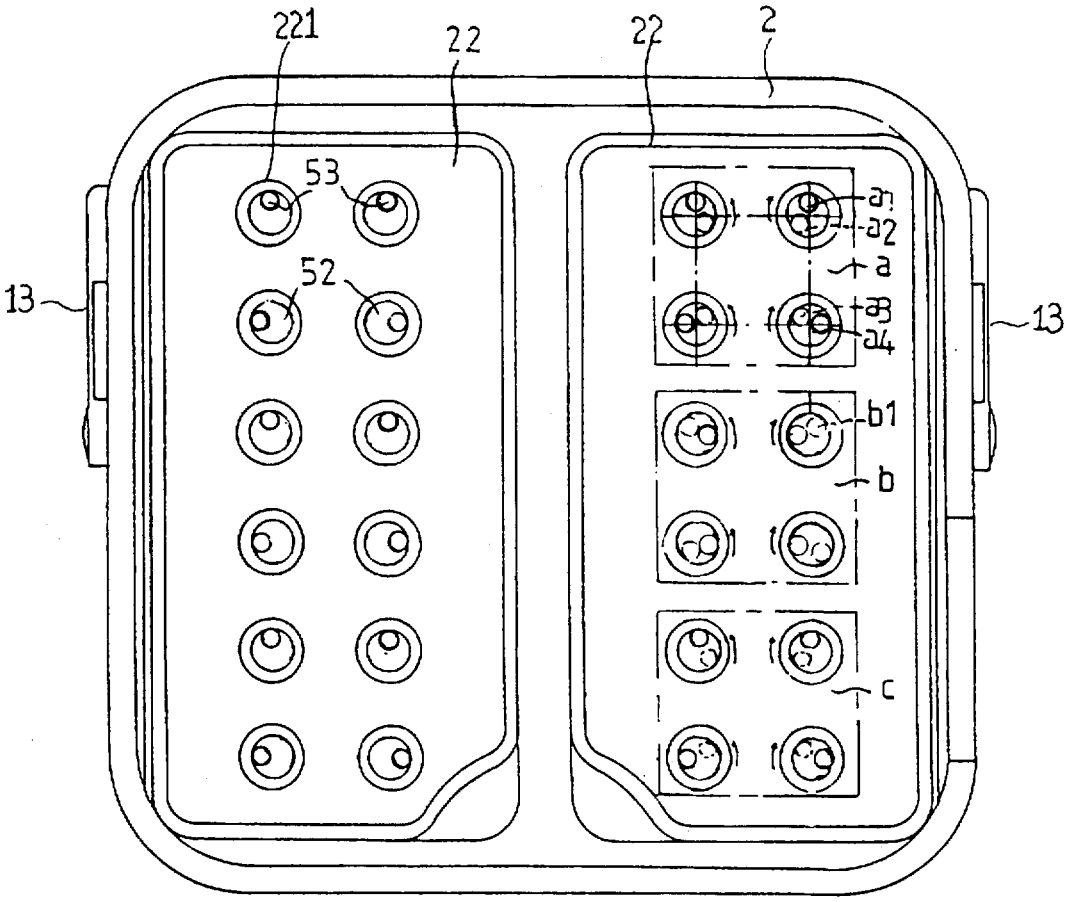
FIG. 5 is a schematic top view of the massager of the invention.
Figure 6:
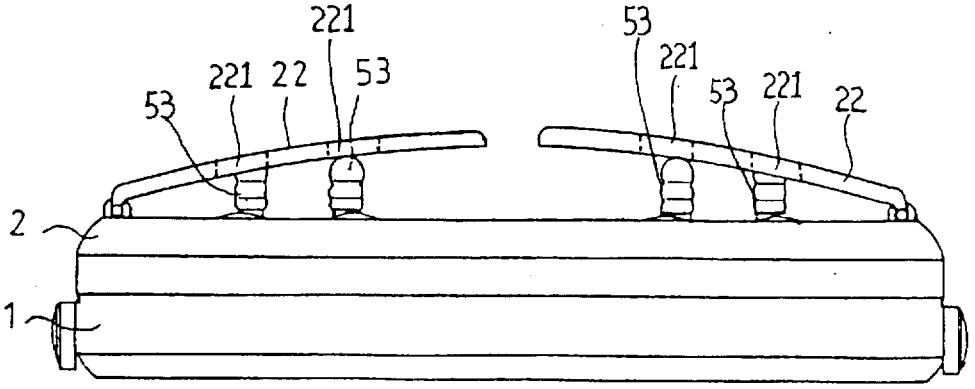
FIG. 6 is a side view of the massager of the invention.

In summary, the present invention is characterized in that the position of the connecting heads 52 on the corresponding screw pinions may be desirably adjusted so that the positions of the massaging heads 53 in each unit may correspond, as shown in FIG. 5. To illustrate, the massaging heads 53 indicated on the right side of the figure are divided into three units, a, b and c. The massaging heads 53 in unit a may be arranged in a diagonal relationship (shown by imaginary lines in the figure). Suppose the massaging head 53 on the left side of the unit a rotates clockwisely, then the massaging head 53 on the right side of the unit a rotates counterclockwisely. With further reference to the figure, the massaging head 53 on the upper right side of the unit a rotates outwardly from a first position a1 to a second position a2 and the massaging head 53 on the lower right side of the unit a rotates inwardly from a first position a3 to a second position a1. Likewise, the same arrangement may be applied to units b and c. If desired, the positions of the massaging heads 53 of the unit b may be adjusted to achieve rotation in a direction opposite to that of units a and c for better massaging effects.

Although the present invention has been illustrated and described with reference to the preferred embodiment thereof, it should be understood that it is in no way limited to the details of such embodiment but is capable of numerous modifications within the scope of the appended claims.

What is claimed is:

1. A massager comprising:

a) a base b) a movable cover movably mounted on the base;

c) a plurality of screw pinions rotatably mounted on the base, each screw pinion having an upper surface with a plurality of insert slots formed therein;

d) at least one worm gear rotatably mounted on the base and engaging the plurality of screw pinions such that rotation of the at least one worm gear causes rotation of the plurality of screw pinions;

e) at least one drive motor on the base connected to the at least one worm gear so as to rotate the at least one worm gear;

f) a connecting head having an upper side with a rod extending therefrom adjacent to a periphery of the connecting head, and a lower side with at least two pins extending therefrom such that engagement of the at least two pins and the insert slots removably connect the connecting head to a screw pinion whereby the position of the connecting head relative to the screw pinion is adjustable to one of a plurality of positions; and, g) a massaging head attached to the rod of the connecting head.

2. The massager as claimed in claim 1, wherein said movable cover comprises a plurality of curved movable press plates pivotally connected to the base, said press plates each having a plurality of circular through holes to accommodate said massaging heads.

3. The massager as claimed in claim 1, wherein said plurality of insert slots of each of said screw pinions comprises four insert slots so that said connecting heads may be adjusted to one of four positions.

4. The massager as claimed in claim 1, wherein said massaging head comprises a soft plastic material having inner ridges thereon to provide a resilience to the massaging head.

* * * * *